US010384367B2

(12) United States Patent
Engelfried et al.

(10) Patent No.: US 10,384,367 B2
(45) Date of Patent: Aug. 20, 2019

(54) CUTTING STRAND SEGMENT

(71) Applicant: Robert Bosch GmbH, Stuttgart (DE)

(72) Inventors: Uwe Engelfried, Ostfildern (DE); Petr Grulich, Kirchheim/Teck (DE)

(73) Assignee: Robert Bosch GmbH, Stuttgart (DE)

( * ) Notice: Subject to any disclaimer, the term of this patent is extended or adjusted under 35 U.S.C. 154(b) by 278 days.

(21) Appl. No.: 14/424,520

(22) PCT Filed: Jul. 22, 2013

(86) PCT No.: PCT/EP2013/065388
§ 371 (c)(1),
(2) Date: Feb. 27, 2015

(87) PCT Pub. No.: WO2014/032857
PCT Pub. Date: Mar. 6, 2014

(65) Prior Publication Data

US 2015/0231793 A1 Aug. 20, 2015

(30) Foreign Application Priority Data

Aug. 31, 2012 (DE) ..... 10 2012 215 460

(51) Int. Cl.
*B27B 17/02* (2006.01)
*B27B 33/14* (2006.01)

(52) U.S. Cl.
CPC ..... *B27B 33/141* (2013.01); *B27B 17/02* (2013.01); *B27B 33/142* (2013.01); *Y10T 83/925* (2015.04)

(58) Field of Classification Search
CPC ..... B27B 17/00; B27B 17/02; B27B 33/00; B27B 33/02; B27B 33/04; B27B 33/06; B27B 33/08; B27B 33/10; B27B 33/14; B23D 61/021; B23D 61/023; B23D 61/121
(Continued)

(56) References Cited

U.S. PATENT DOCUMENTS 1,634,643 A * 7/1927 Bens ..... B27B 33/142 83/832
2,348,612 A * 5/1944 Deacon ..... B27B 17/02 144/73
(Continued)

FOREIGN PATENT DOCUMENTS

CN 2042001 U 8/1989
CN 1197701 A 11/1998
(Continued)

OTHER PUBLICATIONS

International Search Report corresponding to PCT Application No. PCT/EP2013/065388, dated Oct. 18, 2013 (German and English language document) (9 pages).

*Primary Examiner* — Jason Daniel Prone
*Assistant Examiner* — Richard D Crosby, Jr.
(74) *Attorney, Agent, or Firm* — Maginot, Moore & Beck LLP

(57) ABSTRACT

A cutting strand segment for a cutting strand of a machine tool separating device includes at least one blade carrier element, at least one blade element arranged on the blade carrier element, and at least one cutting depth limiting element arranged on the blade carrier element which is configured to limit a maximum cutting depth of the blade element to a value that is less than 0.5 mm.

16 Claims, 4 Drawing Sheets

(58) Field of Classification Search
USPC ..... 83/830–840; 30/381–387
See application file for complete search history.

(56) References Cited

U.S. PATENT DOCUMENTS

| | | | | | |
|---|---|---|---|---|---|
| 2,589,015 | A | | 3/1952 | Merz | |
| 2,608,222 | A | | 8/1952 | Jensen et al. | |
| 2,749,950 | A | * | 6/1956 | Jamieson | B27B 33/148 299/82.1 |
| 2,774,395 | A | * | 12/1956 | Tweedie | B27B 17/02 299/82.1 |
| 2,798,381 | A | * | 7/1957 | Siverson | B27B 33/14 474/206 |
| 2,924,110 | A | | 2/1960 | Gudmundsen | |
| 3,224,476 | A | | 12/1965 | Chadwick et al. | |
| 3,346,025 | A | * | 10/1967 | Anderson | B27B 33/14 83/833 |
| 3,421,313 | A | * | 1/1969 | Kai | F16G 13/06 474/226 |
| 3,444,907 | A | * | 5/1969 | Chadwick | B27B 33/14 474/206 |
| 3,910,147 | A | * | 10/1975 | Heyerdahl | B23D 65/00 29/509 |
| 3,977,288 | A | * | 8/1976 | Goldblatt | B27B 33/142 83/833 |
| 4,074,604 | A | | 2/1978 | Goldblatt et al. | |
| 4,118,995 | A | * | 10/1978 | Lanz | B21L 9/00 474/206 |
| 4,348,927 | A | * | 9/1982 | Olmr | B27B 33/141 83/830 |
| 4,353,277 | A | * | 10/1982 | Silvon | B27B 33/141 83/833 |
| 4,378,719 | A | * | 4/1983 | Burgess | B27B 33/14 474/222 |
| 4,393,739 | A | * | 7/1983 | Olmr | B27B 33/142 30/138 |
| 4,425,830 | A | * | 1/1984 | Atkinson | B27B 33/141 83/833 |
| 4,459,890 | A | * | 7/1984 | Dolata | B27B 33/141 83/830 |
| 4,581,968 | A | | 4/1986 | Gibson et al. | |
| 4,590,836 | A | * | 5/1986 | Doiron | B27B 33/141 83/830 |
| 4,625,610 | A | | 12/1986 | Petrovich | |
| 4,756,221 | A | * | 7/1988 | Nitschmann | B27B 33/14 83/830 |
| 4,796,360 | A | | 1/1989 | Fischer et al. | |
| 4,796,502 | A | | 1/1989 | Anderson | |
| 4,813,323 | A | * | 3/1989 | Harfst | B27B 33/14 83/830 |
| 4,901,613 | A | | 2/1990 | Carlton | |
| 5,123,400 | A | * | 6/1992 | Edgerton | B27B 33/14 125/21 |
| 5,165,318 | A | * | 11/1992 | Wesley | B23D 63/162 83/834 |
| 5,257,568 | A | * | 11/1993 | Nitschmann | B27B 33/14 83/151 |
| 5,404,707 | A | * | 4/1995 | Suzuki | B21G 7/02 59/71 |
| 5,666,871 | A | * | 9/1997 | Burrows | B23D 61/021 83/830 |
| 5,974,933 | A | | 11/1999 | Burrows et al. | |
| 6,058,825 | A | * | 5/2000 | Harfst | B27B 33/141 30/166.3 |
| 6,138,658 | A | * | 10/2000 | Bell | B28D 1/124 125/21 |
| 7,637,192 | B2 | * | 12/2009 | Goettel | B27B 33/141 83/830 |
| 7,713,006 | B2 | * | 5/2010 | MacLennan | B23C 5/207 407/113 |
| 8,602,015 | B2 | * | 12/2013 | Michelon | B27B 33/14 125/21 |
| 8,960,178 | B2 | * | 2/2015 | Buchholtz | B28D 1/08 125/21 |
| 9,561,600 | B2 | * | 2/2017 | Droβler | B27B 33/14 |
| 9,757,808 | B2 | * | 9/2017 | Harfst | B23D 65/00 |
| 2003/0126952 | A1 | * | 7/2003 | Duquet | B27B 33/145 76/112 |
| 2003/0192418 | A1 | * | 10/2003 | Mang | B27B 33/141 83/833 |
| 2006/0243097 | A1 | * | 11/2006 | Raczykowski | B27B 33/144 76/112 |
| 2008/0110317 | A1 | * | 5/2008 | Osborne | B27B 33/14 83/830 |
| 2010/0005668 | A1 | * | 1/2010 | Yancey | B27B 17/0083 30/372 |
| 2014/0041502 | A1 | * | 2/2014 | Fuchs | B27B 17/02 83/831 |
| 2014/0150621 | A1 | * | 6/2014 | Rabinovich | B27B 33/14 83/830 |
| 2014/0260875 | A1 | * | 9/2014 | Harfst | B23D 65/00 83/830 |
| 2015/0231793 | A1 | * | 8/2015 | Engelfried | B27B 33/141 30/383 |
| 2016/0136837 | A1 | * | 5/2016 | Szymanski | B27B 33/14 83/830 |
| 2016/0193749 | A1 | * | 7/2016 | Seigneur | B27B 33/14 83/830 |

FOREIGN PATENT DOCUMENTS

| | | | |
|---|---|---|---|
| CN | 1427755 | A | 7/2003 |
| CN | 2832390 | Y | 11/2006 |
| CN | 102089107 | A | 6/2011 |
| DE | 405742 | | 11/1924 |
| DE | 419108 | | 9/1925 |
| DE | 814 787 | C | 9/1951 |
| DE | 25 00 436 | A1 | 7/1975 |
| DE | 87 09 273.5 | U1 | 10/1987 |
| DE | 42 37 781 | A1 | 5/1994 |
| EP | 0 439 085 | A1 | 1/1991 |

* cited by examiner

CUTTING STRAND SEGMENT

This application is a 35 U.S.C. § 371 National Stage Application of PCT/EP2013/065388, filed on Jul. 22, 2013, which claims the benefit of priority to Serial No. DE 10 2012 215 460.4, filed on Aug. 31, 2012 in Germany, the disclosures of which are incorporated herein by reference in their entirety.

BACKGROUND

There are already known cutting strand segments for a cutting strand of a power-tool parting device, which comprise a cutter carrier element, a cutting element disposed on the cutter carrier element, and a cut-depth limiting element, disposed on the cutter carrier element, for limiting a maximum depth of cut of the cutting element.

SUMMARY

The disclosure is based on a cutting strand segment for a cutting strand of a power-tool parting device, comprising at least one a cutter carrier element, comprising a cutting element disposed on the cutter carrier element, and comprising at least one cut-depth limiting element, disposed on the cutter carrier element, for limiting a maximum depth of cut of the cutting element.

It is proposed that the cut-depth limiting element limit a maximum depth of cut of the cutting element to a value of less than 0.5 mm. A "cutting strand segment" is to be understood here to mean, in particular, a segment of a cutting strand provided to be connected to further segments of the cutting strand for the purpose of constituting the cutting strand. "Provided" is to be understood here to mean, in particular, specially designed and/or specially equipped. Preferably, the cutting strand segment is realized as a chain link, which is connected to further cutting strand segments, realized as chain links, for the purpose of constituting the cutting strand, preferably realized as a cutting chain. In particular, the cutting strand segment has a maximum weight that is less than 1 g, preferably less than 0.5 g, and particularly preferably less than 0.2 g. The cutting strand segment in this case can be realized as a driving member, as a connecting member, as a cutting member, etc. of a cutting chain. The cutting strand in this case can be realized as a cutting chain having one, two or three link plates. Preferably, for the purpose of forming the cutting strand, the cutter carrier element is coupled, in particular connected in a form-fitting manner, to a further cutter carrier element of a further cutting strand segment of the cutting strand. A "cutter carrier element" is to be understood here to mean, in particular, an element on which there is disposed at least one cutting element for parting off and/or removing material particles of a workpiece on which work is to be performed. The cutting element in this case can be realized as a semi-chisel tooth, as a full-chisel tooth, as a "scratcher" tooth, etc., or as a V-tooth, as a hump tooth, as a standard tooth, in particular as a standard tooth standard tooth realized to have the shape of an equilateral triangle, etc. It is also conceivable, however, for the cutting element to have a different tooth shape, considered appropriate by persons skilled in the art. Particularly preferably, the cutting element is realized so as to be other than a chipper tooth, semi-chisel tooth and full-chisel tooth. In particular, the cutting element is realized as a "scratcher" tooth. The cutting element in this case is preferably realized as a standard wood-cutting tooth or standard metal-cutting tooth. The cutting element in this case is fixed to the cutter carrier element by means of a form-fitting, force-fitting and/or adhesive connection. Particularly preferably, the cutting element is realized so as to be integral with the cutter carrier element. "Integral with" is to be understood to mean, in particular, connected at least by adhesive force, for example by a welding process, a bonding process, an injection process and/or another process considered appropriate by persons skilled in the art, and/or, advantageously, formed in one piece such as, for example, by being produced from a casting and/or by being produced in a single or multi-component injection process and, advantageously, from a single blank.

Particularly preferably, the cutting strand segment has a connecting element, disposed on the cutter carrier element, and has a connecting recess, disposed on the cutter carrier element, for receiving a connecting element disposed on the further cutter carrier element that can be connected to the cutter carrier element. Preferably, the connecting element is integrally formed on to the cutter carrier element. A distance between a central axis of the connecting element and the connecting recess, a so-called spacing of the cutting strand is, in particular, less than 6 mm, preferably less than 5 mm, and particularly preferably less than 4 mm. In an alternative design of the cutting strand segment according to the disclosure, the connecting element is realized as a component that is realized so as to be separate from the cutter carrier elements. The cutter carrier elements in this case preferably each have two connecting recesses, into each of which a connecting element can be inserted, wherein the connecting element, following insertion, is fixed to the cutter carrier element and the further cutter carrier element by means of a forming process such as, for example, a stamping process, or by means of an adhesive process. The term "connecting element" is intended here to define, in particular, an element provided to join together in a form-fitting and/or force-fitting manner, in particular to join together in a movable manner, at least two components, in order to transmit a driving force and/or a driving torque.

The term "cut-depth limiting element" is intended here to define, in particular, an element that, when work is being performed on a workpiece, in particular during removal of at least one workpiece chip, limits penetration of the cutting element into the workpiece to a maximum value and thereby defines a maximum chip thickness of a workpiece chip removed when work is being performed on a workpiece. The cut-depth limiting element, as viewed along a cutting direction of the cutting element, is preferably disposed after the cutting element, on the cutter carrier element. It is also conceivable, however, for the cut-depth limiting element to be disposed at a different position on the cutter carrier element, considered appropriate by persons skilled in the art, such as, for example, as viewed along the cutting direction of the cutting element, before and after the cutting element, next to the cutting element, etc. A "cutting direction" is to be understood here to mean, in particular, a direction along which the cutting element is moved, in at least one operating state, as a result of a driving force and/or a driving torque, in particular in a guide unit of the power-tool parting device, for the purpose of generating a cutting clearance and/or parting-off and/or removing material particles, in particular workpiece chips, of a workpiece on which work is to be performed. Advantageously, owing to the design of the cutting strand segment according to the disclosure, the cutting element is subjected only to a small amount of loading during removal of a workpiece chip when work is being performed on a workpiece. Moreover, advantageously, the cutting strand segment according to the disclosure makes it possible to achieve a cut with little tearing.

Advantageously, the cut-depth limiting element limits a maximum depth of cut of the cutting element to a value of less than 0.3 mm, in particular to a value of less than 0.25 mm. Thus, advantageously, when work is being performed on a workpiece, the cutting strand segment can run without jolting, in particular when the cutting strand segment has been connected to further cutting strand segments of the cutting strand.

Furthermore, it is proposed that the cutting strand segment have at least one transverse securing element, which is disposed on the cutter carrier element and which is provided to secure the cutter carrier element, when in a mounted state, insofar as possible against a transverse movement relative to a further cutter carrier element of the cutting strand. The transverse securing element is preferably formed on to the cutter carrier element by tensile forming. It is also conceivable, however, for the transverse securing region to be disposed on the cutter carrier element by means of another type of connection considered appropriate by persons skilled in the art, such as, for example, by means of a form-fit connection method (clip on by means of resilient hook regions, etc.), by means of a welding method, etc. Particularly preferably, the cutter carrier element has at least one stamped transverse securing element. A "transverse securing element" is to be understood here to mean, in particular, an element that, as a result of a form fit and/or as a result of a force fit, to secure a movement along a transverse axis that runs at least substantially perpendicularly in relation to a cutting plane of the cutting strand. The term "cutting plane" is intended here to define, in particular, a plane in which the cutting strand segment is moved for the purpose of performing work on a workpiece, in at least one operating state. Preferably, when work is being performed on a workpiece, the cutting plane is aligned at least substantially transversely in relation to a workpiece surface on which work is to be performed.

"At least substantially transversely" is to be understood here to mean, in particular, an alignment of a plane and/or a direction, relative to a further plane and/or a further direction, that is preferably other than a parallel alignment of the plane and/or the direction relative to the further plane and/or the further direction. It is also conceivable, however, for the cutting plane, during working of a workpiece, to be aligned at least substantially parallelwise in relation to a workpiece surface to be worked, in particular if the cutting element is realized as an abrasive means, etc. "At least substantially parallelwise" is intended here to mean, in particular, an alignment of a direction relative to a reference direction, in particular in one plane, the direction deviating from the reference direction by, in particular, less than 8°, advantageously less than 5°, and particularly advantageously less than 2°. Preferably, the transverse securing element is realized so as to differ from a rivet head or a screw head. Preferably, the transverse securing element is provided to secure, or delimit, a transverse movement, by means of a form fit. It is also conceivable, however, for the transverse securing element to at least secure, or limit, a transverse movement in a different manner, considered appropriate by persons skilled in the art, such as, for example, by means of a magnetic force. The expression "when the cutter carrier element is in a mounted state, to secure insofar as possible against a transverse movement relative to a further cutter carrier element of the cutting strand" is intended here to define, in particular, a limitation of a movement of the cutter carrier elements, connected to each other by means of at least one connecting element, relative to each other, by means of the transverse securing element, along a movement distance that is at least substantially perpendicular to a cutting plane of the cutting strand. The movement distance of the cutter carrier elements relative to each other in this case is limited, in particular by means of the transverse securing element, to a value of less than 5 mm, preferably less than 2 mm, and particularly preferably less than 1 mm. Advantageously, the design according to the disclosure makes it possible to prevent, at least to a very large extent, a lateral displacement of the cutter carrier element relative to the further cutter carrier element during operation, in particular during the making of a cut, etc. Thus, advantageously, a precise work result can be achieved.

Preferably, the transverse securing element is disposed on the connecting element. Particularly preferably in this case, after the cutter carrier element has been coupled to the further cutter carrier element, the transverse securing element is formed on to the connecting element by a forming process. Preferably, following coupling and following forming-on of the transverse securing element, the cutter carrier element and the further cutter carrier element have at least one clearance fit. Preferably, a rotatable mounting is realized by means of the clearance fit and by means of a combined action of the connecting element of the cutter carrier element and a connecting recess of the further cutter carrier element. Advantageously, by means of the design according to the disclosure, the cutter carrier element can be reliably secured against displacement relative to the further cutter carrier element while work is being performed on a workpiece by means of the power-tool parting device according to the disclosure.

Advantageously, the connecting element is realized in the form of a stud. In this case, the connecting element has a circular cross section, as viewed in a plane that is at least substantially parallel to the cutting plane. Particularly preferably, the connecting element is realized in the form of a cylinder. It is also conceivable, however, for the connecting element to be of another design, considered appropriate by persons skilled in the art. A connecting element can be achieved by simple design means. Particularly preferably, after at least the cutter carrier element has been coupled to the further cutter carrier element of the cutting strand, the transverse securing element is stamped on to the connecting element of the cutting strand by means of a stamping device. Advantageously, the cutter carrier element can be secured to the further cutter carrier element in a reliable manner.

It is additionally proposed that the transverse securing element have at least one securing region that is at least substantially parallel to the cutting plane of the cutting element. Preferably, the securing region is in the shape of a circular ring, or circle. It is also conceivable, however, for the securing region be of a different shape, considered appropriate by persons skilled in the art, such as, for example, shaped as a sector of a circular ring, or as a partial extension, etc. Particularly preferably, the securing region is formed directly on to the connecting element as the result of a forming process, after the cutter carrier element and the further cutter carrier element have been mounted. By means of the design according to the disclosure, securing of the cutter carrier element can be realized in a structurally simple manner. Moreover, advantageously, it is advantageously possible to prevent the cutter carrier element and the further cutter carrier element from being unintentionally demounted after the transverse securing element securing region has formed on.

Furthermore, it is proposed that the cutting strand segment have a maximum volume that is less than 20 $mm^3$. Preferably, the cutting strand segment has a maximum volume that is less than 10 $mm^3$, and particularly preferably less than 5 $mm^3$. Advantageously, the cutting strand segment can be produced inexpensively, with only a small amount of material being required.

Advantageously, the cutting strand segment, as viewed along a direction that is at least substantially perpendicular to a cutting plane of the cutting element, has a maximum dimension that is less than 4 mm. Preferably, the cutting strand segment, as viewed along a direction that is at least substantially perpendicular to a cutting plane of the cutting element, has a maximum dimension that is less than 3 mm, and particularly preferably less than 2.5 mm. Advantageously, a very compact cutting strand segment can be achieved, which can be used to make a narrow cut.

The disclosure is additionally based on a method for producing at least one cutting strand segment according to the disclosure. In this case, in a first step of the method, the cutting strand segment is preferably punched out of a strip stock by means of a punching device. In this case, for example, the connecting element and further functional regions of the cutting strand segment may be formed on to the cutting strand segment by means of a combined action of a lower die and an upper die during the punching process. It is also conceivable, however, for the cutting strand segment to be produced by means of a metal injection molding method (MIM method), or by means of another method, considered appropriate by persons skilled in the art. The method according to the disclosure makes it possible, advantageously, to achieve cost-effective production.

Furthermore, the disclosure is based on a cutting strand for a power-tool parting device, having at least one cutting strand segment according to the disclosure. A "cutting strand" is to be understood here to mean, in particular, a unit provided to locally undo an atomic coherence of a workpiece on which work is to be performed, in particular by means of a mechanical parting-off and/or by means of a mechanical removal of material particles of the workpiece. Preferably, the cutting strand is provided to separate the workpiece into at least two parts that are physically separate from each other, and/or to part off and/or remove, at least partially, material particles of the workpiece, starting from a surface of the workpiece. Particularly preferably, in at least one operating state, the cutting strand is moved in a revolving manner, in particular along a circumferential direction of a guide unit of the power-tool parting device. The cutting strand is preferably formed by connection of a plurality of cutting strand segments. The cutting strand is thus preferably realized as a cutting chain. The cutting strand segments in this case can be connected to each other in a separable manner, such as, for example, by means of a chain connecting link, etc., and/or in an inseparable manner. It is also conceivable, however, for the cutting strand to be realized as a cutting band and/or cutting cord. If the cutting strand is realized as a cutting band and/or cutting cord, the cutting strand segments are fixed directly to the cutting band and/or cutting cord. The cutting strand segments in this case can be spaced apart from each other and/or disposed in direct contact with each other on the cutting band and/or cutting cord. The design according to the disclosure makes it possible, advantageously, to realize a cutting strand that, in operation, runs at least substantially without jolting. Moreover, advantageously, the cut-depth limiting elements of the individual cutting strand segments minimize any risk of breakage of the chain caused by overloading resulting from the cutting elements penetrating deeply into a workpiece on which work is to be performed.

The disclosure is additionally based on a power-tool parting device, in particular a hand-held power-tool parting device, having a cutting strand according to the disclosure. Preferably, the power-tool parting device comprises a guide unit for guiding the cutting strand, the guide unit and the cutting strand together constituting a closed system. A "guide unit" is to be understood here to mean, in particular, a unit provided to exert a constraining force upon the cutting strand, at least along a direction perpendicular to a cutting direction of the cutting strand, in order to define a possibility for movement of the cutting strand along the cutting direction. Preferably, the guide unit has at least one guide element, in particular a guide groove, by which the cutting strand is guided. Preferably, the cutting strand, as viewed in a cutting plane, is guided by the guide unit along an entire circumference of the guide unit, by means of the guide element, in particular the guide groove. The term "closed system" is intended here to define, in particular, a system comprising at least two components that, by means of combined action, when the system has been demounted from a system such as, for example, a power tool, that is of a higher order than the system, maintain a functionality and/or are inseparably connected to each other when in the demounted state. Preferably, the at least two components of the closed system are connected to each other so as to be at least substantially inseparable by an operator. "At least substantially inseparable" is to be understood here to mean, in particular, a connection of at least two components that can be separated from each other only with the aid of parting tools such as, for example, a saw, in particular a mechanical saw, etc. and/or chemical parting means such as, for example, solvents, etc. Advantageously, an insert tool can be realized that can be used in an effective manner, being suitable for a broad spectrum of working on workpieces.

Furthermore, it is proposed that the power-tool parting device comprise at least the guide unit, wherein the cutting strand segment has at least one segment guide element, which is disposed on the cutter carrier element and which is provided to limit a movement of the cutting strand segment, when the cutting strand is disposed on the guide unit, as viewed in a direction away from the guide unit, at least along a direction that is at least substantially parallel to a cutting plane of the cutting element. Particularly preferably, each cutting strand segment of the cutting strand of the power-tool parting device has at least one segment guide element, which is provided to limit a movement of the respective cutting-strand element, when disposed in a guide unit, as viewed in a direction away from the guide unit, at least along a direction that is at least substantially parallel to a cutting plane of the cutting strand. Preferably, the guide unit has at least one segment counter-guide element that corresponds to the segment guide element. Preferably, the guide unit has at least one guide element, in particular a guide groove, by which the cutting strand is guided. Preferably, the cutting strand, as viewed in the cutting plane, is guided by the guide unit along an entire circumference of the guide unit by the guide unit by means of the guide element, in particular the guide groove. It is thereby possible, through simple design means, to achieve guidance along a direction of the cutting strand that extends at least substantially parallelwise in relation to a cutting plane of the cutting strand.

Furthermore, the disclosure is based on a power tool having at least one coupling device for coupling in a form-fitting and/or force-fitting manner to a power-tool parting device according to the disclosure. The power tool is preferably realized as a portable power tool. A "portable power tool" is to be understood here to mean in particular a power tool, in particular a hand-held power tool, that can be transported by an operator without the use of a transport machine. The portable power tool has, in particular, a mass of less than 40 kg, preferably less than 10 kg, and particularly preferably less than 5 kg. Preferably, the power tool and die power-tool parting device together constitute a power-tool system. Advantageously, by means of the design of the power tool according to the disclosure, it is possible to achieve a portable power tool that, particularly advantageously, is suitable for a broad spectrum of applications.

The cutting strand segment according to the disclosure, the cutting strand according to the disclosure, the power-tool parting device according to the disclosure and/or the portable power tool according to the disclosure are/is not intended in this case to be limited to the application and embodiment described above. In particular, the cutting strand segment according to the disclosure, the cutting strand according to the disclosure, the power-tool parting device according to the disclosure and/or the portable power tool according to the disclosure may have individual elements, components and units that differ in number from a number stated herein, in order to fulfill a principle of function described herein.

BRIEF DESCRIPTION OF THE DRAWINGS

Further advantages are given by the following description of the drawing. The drawing shows exemplary embodiments of the disclosure. The drawing, the description and the claims contain numerous features in combination. Persons skilled in the art will also expediently consider the features individually and combine them to create appropriate further combinations.

In the drawings.

DETAILED DESCRIPTION

Figure 1:
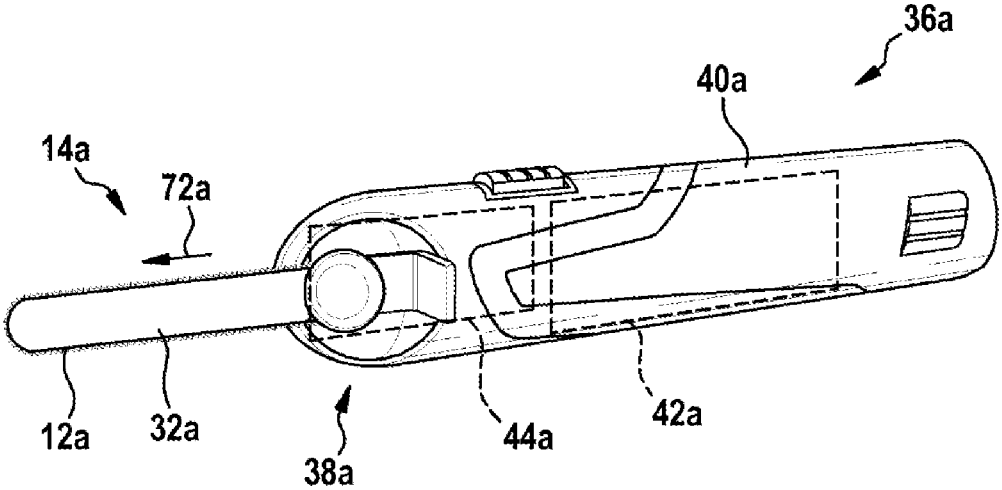
FIG. 1 shows a portable power tool according to the disclosure, having a power-tool parting device according to the disclosure, in a schematic representation.

FIG. 1 shows a portable power tool 36*a*, having a power-tool parting device 14*a*, which together constitute a power-tool system. The portable power tool 36*a* has a coupling device 38*a* for coupling in a form-fitting and/or force-fitting manner to the power-tool parting device 14*a*. The coupling device 38*a* in this case can be realized as a bayonet closure and/or as another coupling device, considered appropriate by persons skilled in the art. The portable power tool 36*a* additionally has a power-tool housing 40*a*, which encloses a drive unit 42*a* and a transmission unit 44*a* of the portable power tool 36*a*. The drive unit 42*a* and the transmission unit 44*a* are connected to each other, in a manner already known to persons skilled in the art, to generate a drive torque that can be transmitted to the power-tool parting device 14*a*. The transmission unit 44*a* is realized as a bevel gear transmission. The drive unit 42*a* is realized as an electric motor unit. It is also conceivable, however, for the drive unit 42*a* and/or the transmission unit 44*a* to be of a different design, considered appropriate by persons skilled in the art. The drive unit 42*a* is provided to drive a cutting strand 12*a* of the power-tool parting device 14*a* at a cutting speed of less than 6 m/s, when in at least one operating state. The portable power tool 36*a* in this case has at least one operating mode, in which it is possible for the cutting strand 12*a* to be driven at a cutting speed of less than 6 m/s, in a guide unit 32*a* of the power-tool parting device 14, along a cutting direction 72*a* of a cutting element 18*a* of a cutting strand segment 10*a*.

Figure 2:
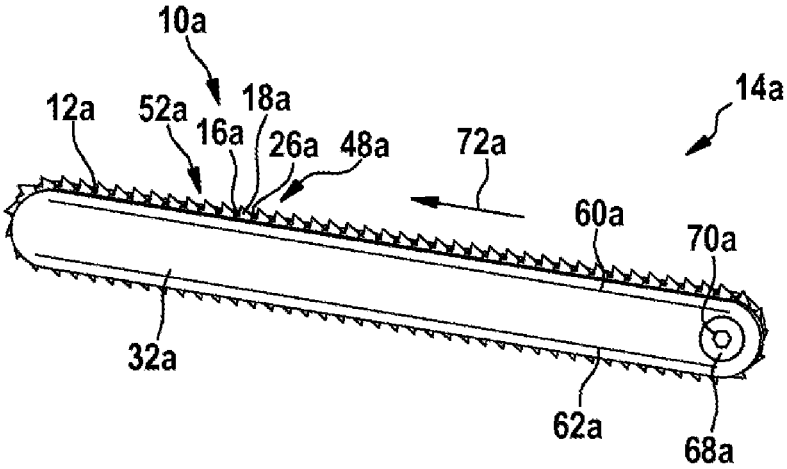
FIG. 2 shows a detail view of the power-tool parting device according to the disclosure, in a schematic representation.

FIG. 2 shows the power-tool parting device 14*a* decoupled from the coupling device 38*a* of the portable power tool 36*a*. The power-tool parting device 14*a* has the cutting strand 12*a*, which comprises at least one cutting strand segment 10*a*. In addition, the power-tool parting device 14*a* has the guide unit 32*a*, which, together with the cutting strand 12*a*, constitutes a closed system. The cutting strand 12*a* is guided by means of the guide unit 32*a*. For this purpose, the guide unit 32*a* has at least one guide groove (not represented in greater detail here). The cutting strand 12*a* is guided by means of edge regions of the guide unit 32*a* that delimit the guide groove. It is also conceivable, however, for the guide unit 32*a* to have a different element for guiding the cutting strand 12*a*, considered appropriate by persons skilled in the art, such as, for example, as a rib-type means, formed on the guide unit 32*a*, that engages in a recess on the cutting strand 12*a*. During operation, the cutting strand 12*a* is moved in a revolving manner along the circumference of the guide unit 32*a*, in the guide groove.

The cutting strand segment 10*a* has at least one connecting element 46*a*, which is realized so as to be integral with a cutter carrier element 16*a* of the cutting strand segment 10*a* (FIG. 3), for connection to a further cutting strand segment 48*a* of the cutting strand 12*a*. The cutting strand 12*a* thus comprises at least one connecting element 46*a* for connecting the cutting strand segment 10*a* and the further cutting strand segment 48*a*. The connecting element 46*a* is realized in the form of a stud. The connecting element 46*a* in this case is provided, by acting in combination with a connecting recess (not represented in greater detail here) of a further cutter carrier element 26*a* of the further cutting strand segment 48*a*, to realize a form-fitting connection between the cutter carrier element 16*a* and the further cutter carrier element 26*a*, or between the cutting strand segment 10*a* and the further cutting strand segment 48*a*. The cutting strand segment 10*a* likewise comprises a connecting recess 50*a*, disposed on the cutter carrier element 16*a*. The connecting recess 50*a* of the cutter carrier element 16*a* acts in combination with a further connecting element (not represented in greater detail here) of the cutting strand 12*a*, or of a third cutting strand segment 52*a*, to form the cutting strand 12*a*. Each cutting strand segment of the cutting strand 12*a* thus comprises at least one connecting element, disposed on the respective cutter carrier element of the cutting strand segments, and at least one connecting recess, disposed on the respective cutter carrier element of the cutting strand segments. Thus, by means of a combined action of the connecting elements and the connecting recesses, the cutting strand segments of the cutting strand 12*a* are mounted so as to be pivotable relative to each other.

The connecting element 46*a* of the cutting strand segment 10*a* closes in an at least substantially flush manner with at least one outer face 54*a* of the cutter carrier element 16*a*. It is also conceivable, however, for the connecting element 46*a* to project beyond the outer face 54*a*, as viewed along a direction at least substantially perpendicular to the outer face 54*a*, or to be set back relative to the outer face 54*a*. By projecting, or by closing in a flush manner with the outer face 54*a* of the connecting element 46*a*, the cutting strand segment 10*a*, when disposed in the guide groove, can be guided by means of the connecting element 46*a* at edge regions of the guide groove.

Figure 3:
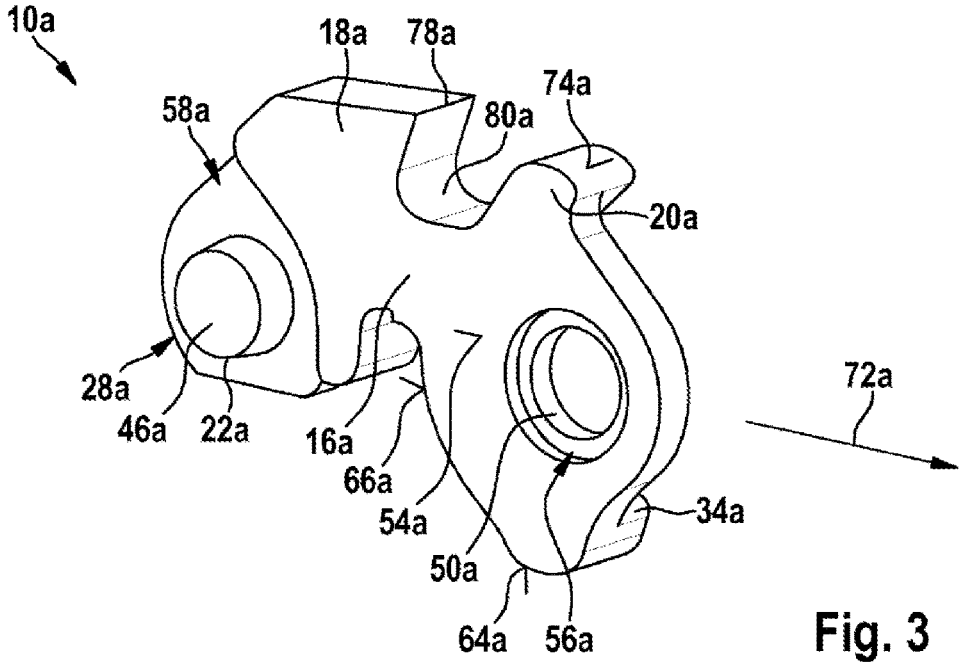
FIG. 3 shows a detail view of a cutting strand segment according to the disclosure of a cutting strand according to the disclosure, in a schematic representation.

In addition, the cutting strand segment 10*a* has at least one transverse securing element 22*a*, which is disposed on the cutter carrier element 16*a* and which is provided to secure insofar as possible the cutter carrier element 16*a*, when in a mounted state, against a transverse movement relative to the further cutter carrier element 26*a* of the cutting strand 12*a* (FIG. 3). The cutting strand segment 10*a* has at least one stamped transverse securing element 22*a*. The transverse securing element 22*a* is disposed on the connecting element 46*a*. The transverse securing element 22*a* in this case has at least one securing region 28*a*, which is at least substantially parallel to a cutting plane of the cutting element 18*a*. The securing region 28*a* is thus at least substantially parallel to the outer face 54*a* of the cutter carrier element 16*a*. The transverse securing element 22*a* is stamped on to the connecting element 46*a* of the cutting strand 12*a* by means of a stamping device, after at least the cutter carrier element 16*a* has been coupled to the further cutter carrier element 26*a* of the cutting strand 12*a*. The securing region 28*a* is thus realized as a result of the stamping of the transverse securing element 22*a*.

The securing region 28*a* is provided, by acting in combination with a counter-securing region (not represented in greater detail here), in the form of a groove having the shape of a circular ring, of the further cutter carrier element 26*a*, to secure insofar as possible the cutter carrier element 16*a*, when in a mounted state, in at least one direction that is at least substantially perpendicular to the outer face 54*a*, against a transverse movement relative to the further cutter carrier element 26*a* of the cutting strand 12*a*. The cutting strand segment 10*a* likewise has a counter-securing region 56*a* in the form of a groove having the shape of a circular ring. The counter-securing region 56*a* is disposed in the region of the connecting recess 50*a*, on the cutter carrier element 16*a*. Furthermore, following connection of the connecting element 46*a* of the cutter carrier element 16*a* and a connecting recess of the further cutter carrier element 26*a*, the cutter carrier element 16*a* is secured insofar as possible, in at least one further direction that is at least substantially perpendicular to the outer face 54*a*, against a transverse movement relative to the further cutter carrier element 26*a*, by means of a combined action of an edge region of the further cutter carrier element 26*a*, that delimits the connecting recess of the further cutter carrier element 26*a*, with a coupling region 58*a* of the cutter carrier element 16*a* that surrounds the connecting element 46*a* of the further cutter carrier element 26*a*. In this case, each cutter carrier element of the cutting strand segments of the cutting strand 12*a* comprises at least one transverse securing element, which is disposed on the connecting element by means of stamping, after coupling to the further cutter carrier element.

Furthermore, the cutting strand segment 10*a* has at least one segment guide element 34*a*, which is disposed on the cutter carrier element 16*a* and which is provided to limit a movement of the cutting strand segment 10*a*, when disposed on the guide unit 32*a*, as viewed in a direction away from the guide unit 32*a*, at least along a direction that is at least substantially parallel to the cutting plane of the cutting element 18*a* (FIG. 3). The segment guide element 34*a* is constituted by a transverse extension, which extends at least substantially perpendicularly in relation to the outer face 54*a* of the cutter carrier element 16*a*. The segment guide element 34*a* in this case delimits a longitudinal groove. The segment guide element 34*a* is provided to act in combination with segment counter guide elements 60*a*, 62*a* of the guide unit 26 that are disposed on an inner face of the guide unit 32*a* that faces toward the cutter carrier element 16*a*, for the purpose of limiting movement (FIG. 2). The segment counter guide elements 60*a*, 62*a* are realized so as to correspond with the segment guide element 34*a* of the cutting strand segment 10*a*. In this case, each of the cutting strand segments of the cutting strand 12*a* comprises at least one segment guide element, which is provided to limit a movement of the cutting strand segments, when disposed in the guide unit 32*a*, as viewed in a direction away from the guide unit 32*a*, at least along a direction that is at least substantially parallel to the cutting plane of the cutting element 18*a*.

Moreover, the cutting strand segment 10*a* has a compressive-force transfer face 64*a*, disposed on the cutter carrier element 16*a* (FIG. 3). The compressive-force transfer face 64*a* is provided, by acting in combination with a compressive-force absorption region (not represented in greater detail here) of the guide unit 32*a*, to support compressive forces that act upon the cutting strand 12*a* as work is being performed on a workpiece (not represented in greater detail here). In this case, the compressive-force absorption region of the guide unit 32*a*, as viewed along a direction that is at least substantially perpendicular to the cutting plane of the cutting element 18*a*, is disposed between two outer faces of the guide unit 32*a* that are at least substantially parallel to each other. In this case, each of the cutting strand segments of the cutting strand 12*a* comprises a compressive-force transfer face.

The cutting strand segment 10*a* additionally has a driving face 66*a*, which is disposed on the cutter carrier element 16*a* and which is provided to act in combination with driving faces of a torque transmission element 68*a* (FIG. 2) of the power-tool parting device 14*a*, for the purpose of driving the cutting strand 12*a*. The driving faces of the torque transmission element 68*a* in this case are realized as tooth flanks. In this case, the driving face 66*a* of the cutter carrier element 14 is realized so as to correspond with the driving faces of the torque transmission element 68*a*. When the cutting strand 12*a* is being driven, the tooth flanks of the torque transmission element 68*a* bear temporarily against the driving face 66*a*, for the purpose of transmitting driving forces. In this case, each cutting strand segment of the cutting strand 12*a* thus comprises a driving face.

For the purpose of driving the cutting strand 12*a*, the torque transmission element 68*a* is rotatably mounted in the guide unit 32*a*. For the purpose of driving the cutting strand 12*a*, the torque transmission element 68*a*, when in a mounted state, is coupled to a pinion (not represented in greater detail here) of the drive unit 42*a* and/or to a gear wheel (not represented in greater detail here) and/or to a toothed shaft (not represented in greater detail here) of the transmission unit 44*a*. The torque transmission element 68*a* in this case has a coupling recess 70*a* that, when in a mounted state, can be coupled to a driving element of the portable power tool 36*a*. The coupling recess 70*a* is disposed concentrically in the torque transmission element 68*a*. In addition, the coupling recess 70*a* is provided to be coupled to the pinion (not represented in greater detail here) of the drive unit 42*a* and/or to a gear wheel (not represented in greater detail here) and/or to a toothed shaft (not represented in greater detail here) of the transmission unit 44*a*, when the torque transmission element 68*a* and/or the power-tool parting device 14*a* are/is in a coupled state. The coupling recess 70*a* is realized as a hexagon socket. It is also conceivable, however, for the coupling recess 70*a* to be of a different design, considered appropriate by persons skilled in the art. Moreover, it is conceivable for the power-tool parting device 14*a*, in an alternative design, not represented in greater detail here, to be realized so as to act in isolation from the torque transmission element 68*a*. In this case, the pinion (not represented in greater detail here) of the drive unit 42*a* and/or the gear wheel (not represented in greater detail here) and/or the toothed shaft (not represented in greater detail here) of the transmission unit 44*a* would engage directly in the guide unit 32*a*, and would act in isolation from interposition of a torque transmission element, disposed in the guide unit 32*a*, for the purpose of driving the cutting strand 12*a*.

In addition, the cutting strand segment 10*a* has at least one cutting element 18*a*, disposed on the cutter carrier element 16*a*. The cutting element 18*a* is realized so as to be integral with the cutter carrier element 16*a*. The cutting element 18*a* is provided to enable a workpiece (not represented in greater detail here) on which work is to be performed to be parted off, and/or to enable material particles to be removed therefrom. For this purpose, the cutting element 18*a* is realized as a "scratcher" tooth. The cutting element 18*a* in this case is at least substantially parallel to the outer face 54*a* of the cutter carrier element 16*a*. The cutting strand segment 10*a* in this case is integrally punched out of a strip stock, in one working step, by means of a punching device. Each cutting strand segment of the cutting strand 12*a* comprises at least one cutting element. It is also conceivable, however, for each of the cutting strand segments of the cutting strand 12*a* to have a different number of cutting elements. The cutting element 18*a* in this case may have a cutting layer (not represented in greater detail here) that comprises at least titanium carbide. The cutting layer is applied to the cutting element 18*a* by means of a CVD process. It is also conceivable, however, for the cutting layer to comprise, alternatively or additionally, another material such as, for example, titanium nitride, titanium carbonitride, aluminum oxide, titanium aluminum nitride, chromium nitride or zirconium carbonitride. Moreover, it is also conceivable for the cutting layer to be applied by means of another process, considered appropriate by persons skilled in the art, such as, for example, by means of a PVD or PACVD process. Furthermore, it is conceivable for the cutting element 18*a* to be provided with particles. In this case, the cutting element 18*a* may be provided with diamond particles, hard metal particles, or other particles considered appropriate by persons skilled in the art.

Furthermore, the cutting strand segment 10*a* comprises at least one cut-depth limiting element 20*a*, disposed on the cutter carrier element 16*a*, for limiting a maximum depth of cut of the cutting element 18*a* (FIG. 3). Thus, the cutting strand segment 10*a* comprises at least the cutter carrier element 16*a*, at least the cutting element 18*a* disposed on the cutter carrier element 16*a*, and at least the cut-depth limiting element 20*a* disposed on the cutter carrier element 16*a*, for limiting a maximum depth of cut of the cutting element 18*a*. The cutting strand segment 10*a* in this case has a maximum volume that is less than 20 $mm^3$. The cut-depth limiting element 20*a* limits a maximum depth of cut of the cutting element 18*a* to a value of less than 0.5 mm. In this case, the cut-depth limiting element 20*a* limits a maximum depth of cut of the cutting element 18*a* to a value of less than 0.3 mm. The maximum depth of cut of the cutting element 18*a* is determined by a distance between a top side 74*a* of the cut-depth limiting element 20*a* and a cutting edge 78*a* of the cutting element 18*a*, as viewed along a direction that, in the cutting plane of the cutting element 18*a*, is at least substantially perpendicular to the cutting direction 72*a* of the cutting element 18*a*. The cut-depth limiting element 20*a*, as viewed along the cutting direction 72*a* of the cutting element 18*a*, is disposed behind the cutting element 18*a*, on the cutter carrier element 16*a*. A chip space 80*a* of the cutting strand segment 10*a* is thus formed, as viewed along the cutting direction 72*a* of the cutting element 18*a*. The cut-depth limiting element 20*a* in this case is realized so as to be integral with the cutter carrier element 16*a*. The cut-depth limiting element 20*a* is formed on to the cutter carrier element 16*a*, in the region of the connecting recess 50*a*. The cutting strand segments of the cutting strand 12*a* all have a respective cut-depth limiting element. It is also conceivable, however, that not every cutting strand segment of the cutting strand 12*a* has a cut-depth limiting element, and for the cutting strand segments to be combined with each other in various arrangements, with and without a cut-depth limiting element, to form the cutting strand 12*a*.

Alternative exemplary embodiments are represented in FIGS. 4 to 7. Components, features and functions that remain substantially the same are denoted, in principle, by the same references. To differentiate the exemplary embodiments, the letters a to c and/or apostrophes have been appended to the references of the exemplary embodiments. The description that follows is limited substantially to the differences in relation to the first exemplary embodiment described in FIGS. 1 to 3, and reference may be made to the description of the first exemplary embodiment in FIGS. 1 to 3 in respect of components, features and functions that remain the same.

Figure 4:
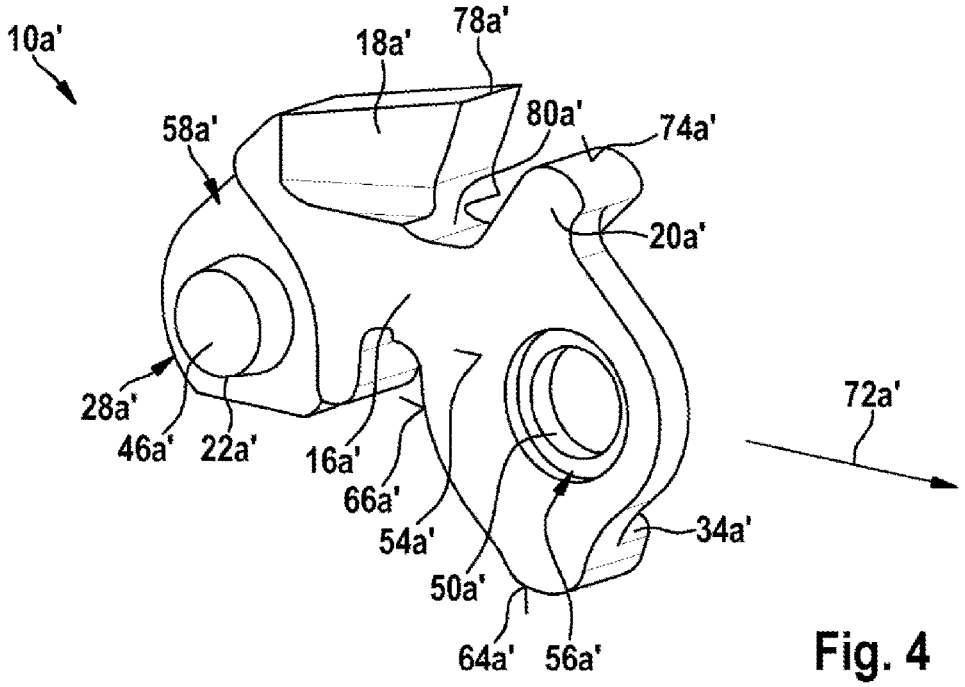
FIG. 4 shows a detail view of an alternative cutting strand segment according to the disclosure, in a schematic representation.

FIG. 4 shows a cutting strand segment 10*a*' as an alternative realization of the cutting strand segment 10*a* from FIG. 3. The cutting strand segment 10*a*' is of a design that is at least substantially similar to that of the cutting strand segment 10*a* from FIG. 3. The difference between the cutting strand segment 10*a* from FIG. 3 and the cutting strand segment 10*a*' consists in a design of the cutting element 18*a* of the cutting strand segment 10*a* from FIG. 3 and that of the cutting element 18*a*' of the cutting strand segment 10*a*' from FIG. 4. The cutting element 18*a*' of the cutting strand segment 10*a* from FIG. 4 has, along a cutting direction 72*a*' of the cutting element 18*a*', a varying offset, relative to an outer face 54*a*' of a cutter carrier element 16*a*' of the cutting strand segment 10*a*'. In this case, the cutting element 18*a*' is disposed on the cutter carrier element 16*a*', inclined relative to the cutter carrier element 16*a*', about two axes running at least substantially perpendicularly, relative to the outer face 54*a*'. The two at least substantially perpendicular axes in this case are preferably at least substantially parallel to the outer face 54*a*' of the cutter carrier element 16*a*' and/or to the cutting plane of the cutting element 18*a*'. In respect of further features of the cutting strand segment 10*a* from FIG. 4, reference may be made to the description of FIGS. 1 to 3. For the purpose of forming the cutting strand 12*a* from FIGS. 1 to 3, a plurality of cutting strand segments 10*a*' from FIG. 4 and a plurality of cutting strand segments

10*a* from FIG. 3 may be disposed in a sequence considered appropriate by persons skilled in the art.

Figure 5:
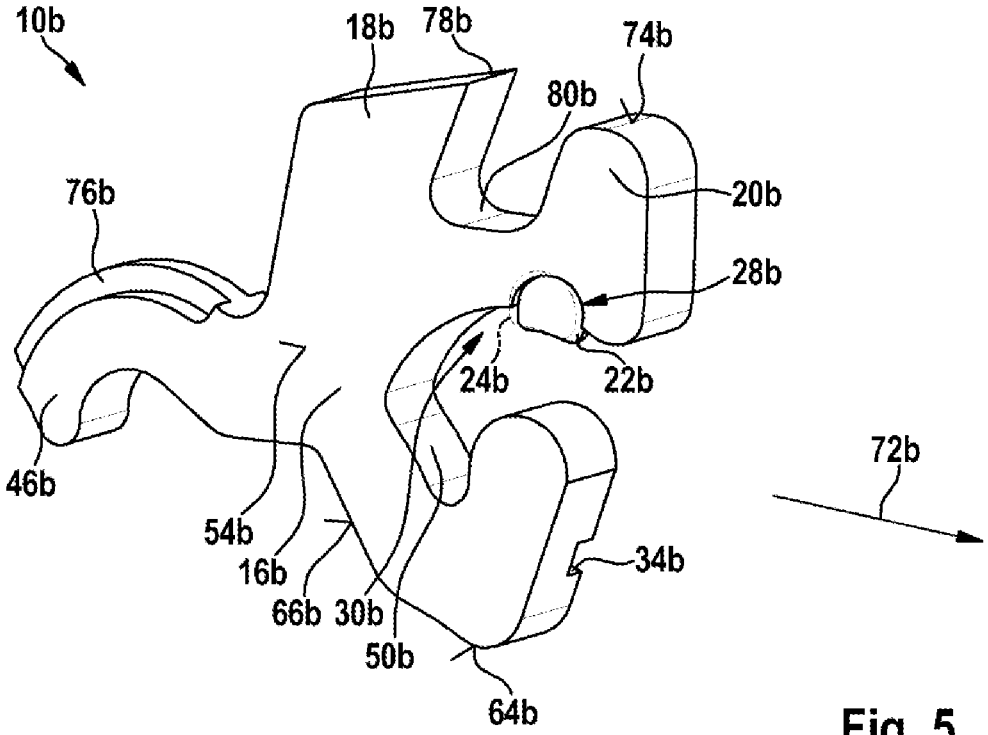
FIG. 5 shows a detail view of a further, alternative cutting strand segment according to the disclosure, in a schematic representation.

FIG. 5 shows a cutting strand segment 10*b* as an alternative realization of the cutting strand segment 10*a* from FIG. 3. The cutting strand segment 10*b* comprises at least one cutter carrier element 16*b*, at least one cutting element 18*b* disposed on the cutter carrier element 16*b*, and at least one cut-depth limiting element 20*b* disposed on the cutter carrier element 16*b*, for limiting a maximum depth of cut of the cutting element 18*b*. The cutting element 18*b* is realized as a "scratcher" tooth. In this case, the cutting element 18*b* is at least substantially parallel to an outer face 54*b* of the cutter carrier element 16*b*. The cutting strand segment 10*b* additionally comprises at least one connecting element 46*b*, disposed on the cutter carrier element 16*b*. The connecting element 46*b* is realized so as to be integral with the cutter carrier element 16*b*. The connecting element 46*b* in this case is realized as an elongate extension of the cutter carrier element 16*b*. The elongate extension is realized in the shape of a hook. The elongate extension in this case is realized so as to be other than a rod-shaped extension, on which there is a formed-on circular form-fitting element, and/or other than a semicircular extension.

Furthermore, the connecting element 46*b*, realized as an elongate extension, has a transverse securing region 76*b* on one side. The transverse securing region 76*b* is provided, by acting in combination with at least one transverse securing element of a further cutter carrier element (not represented in greater detail here) connected to the cutter carrier element 16*b*, to prevent, at least to a very large extent, a transverse movement of the cutter carrier element 16*b* along at least two opposing directions, when in a coupled state, relative to the further cutter carrier element. In this case, the transverse securing region 76*b* is realized as a rib. It is also conceivable, however, for the transverse securing region 76*b* to be of another design, considered appropriate by persons skilled in the art, such as, for example, designed as a groove, etc. The transverse securing region 76*b* is disposed on a side of the connecting element 46*b* that faces toward the cutting element 18*b* that is realized so as to be integral with the cutter carrier element 16*b*. Moreover, the transverse securing region 76*b*, or the connecting element 46*b*, as viewed along a cutting direction 72*b* of the cutting element 18*b*, is disposed on a side of the cutter carrier element 16*b* that faces away from the cut-depth limiting element 20*b*.

The cutting-strand segment 10*b* additionally has two transverse securing elements 22*b*, 24*b*, disposed on the cutter carrier element 16*b*, which are provided to act in combination with a transverse securing region of the further cutter carrier element, when the cutter carrier element 16*b* has been coupled to the further cutter carrier element. The transverse securing elements 22*b*, 24*b* are each disposed in an edge region of the cutter carrier element 16*b* that delimits a connecting recess 50*b* of the cutter carrier element 16*b*. The transverse securing elements 22*b*, 24*b* in this case are realized so as to be integral with the cutter carrier element 16*b*. The transverse securing elements 22*b*, 24*b* are each integrally formed on to the cutter carrier element 16*b*, by means of a stamping process.

Figure 6:
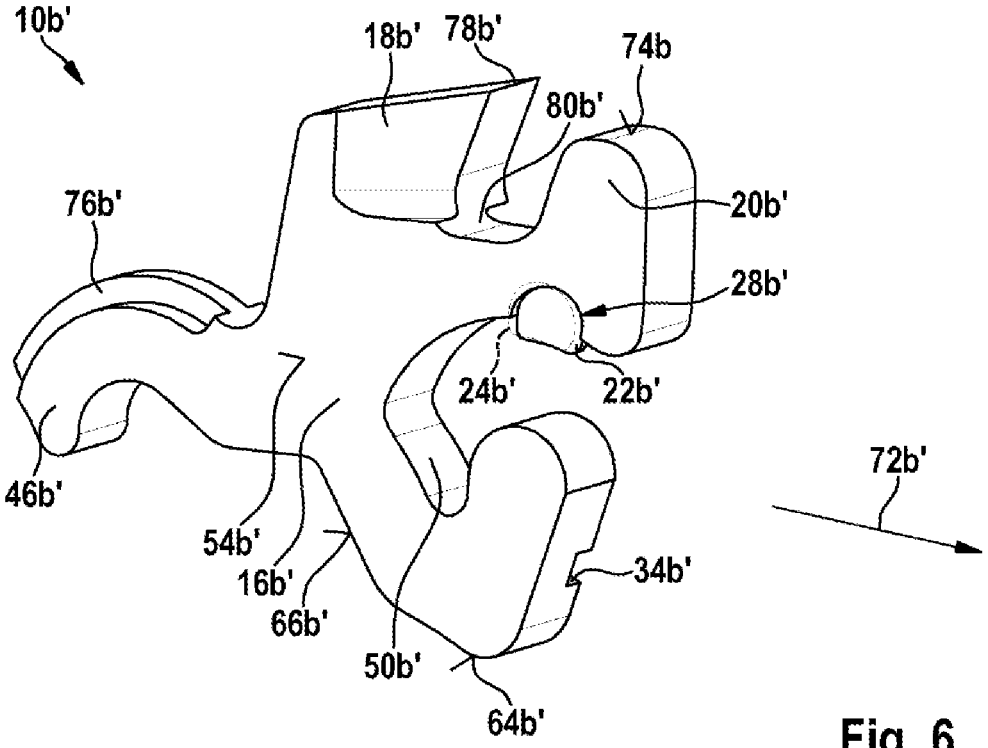
FIG. 6 shows a detail view of a further, alternative cutting strand segment according to the disclosure, in a schematic representation.

FIG. 6 shows a cutting strand segment 10*b*' as an alternative realization of the cutting strand segment 10*b* from FIG. 5. The cutting strand segment 10*b*' is of a design that is at least substantially similar to that of the cutting strand segment 10*b* from FIG. 3. The difference between the cutting strand segment 10*b* from FIG. 3 and the cutting strand segment 10*b*' consists in a design of the cutting element 18*b* of the cutting strand segment 10*b* from FIG. 5 and that of the cutting element 18*b*' of the cutting strand segment 10*b*' from FIG. 6. The cutting element 18*b*' of the cutting strand segment 10*b* from FIG. 6 has, along a cutting direction 72*b*' of the cutting element 18*b*', a varying offset, relative to an outer face 54*b*' of a cutter carrier element 16*b*' of the cutting strand segment 10*b*'. The cutting element 18*b*' in this case is disposed on the cutter carrier element 16*b*', inclined relative to the cutter carrier element 16*b*', about two axes running at least substantially perpendicularly, relative to the outer face 54*b*'. The two at least substantially perpendicular axes in this case are preferably at least substantially parallel to the outer face 54*b*' of the cutter carrier element 16*b*' and/or to the cutting plane of the cutting element 18*b*'. In respect of further features of the cutting strand segment 10*b*' from FIG. 4, reference may be made to the description of FIG. 5.

Figure 7:
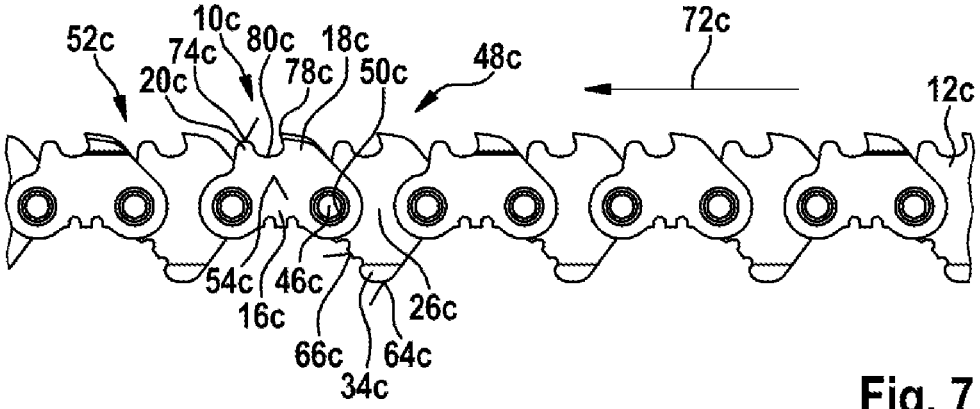
FIG. 7 shows a detail view of an alternative cutting strand according to the disclosure, in a schematic representation.

FIG. 7 shows an alternative cutting strand 12*c*. The cutting strand 12 comprises a multiplicity of cutting strand segments 10*c*, 48*c*, 52*c*, which each comprise at least one cutter carrier element 16*c*, at least one cutting element 18*d* disposed on the cutter carrier element 16*c*, and at least one cut-depth limiting element 20*c*, disposed on the cutter carrier element 16*c*, for limiting a maximum depth of cut of the cutting element 18*c*. The cutting strand 12*c* in this case has two types of cutting strand segment 10*c*, 48*c*, 52*c*. On the one hand, the cutting strand 12*c* has driving-member cutting strand segments and, on the other hand, has cutting-member cutting strand segments, which are disposed alternately in succession along a cutting direction 72*c* of the cutting elements 18*c*. For the purpose of connecting the cutting strand segments 10*c*, 48*c*, 52*c*, the cutting strand 12*c* comprises connecting elements 46*c*, realized separately from the cutting strand segments 10*c*, 48*c*, 52*c*. The connecting elements 46*c* are realized as connecting studs or connecting rivets. In this case, for the purpose of connecting the cutting strand segments 10*c*, 48*c*, 52*c*, the connecting elements 46*c* are pushed into connecting recesses 50*c* of the cutting strand segments 10*c*, 48*c*, 52*c*, and secured against falling out of the connecting recesses 50*c* by means of forming and/or welding a retaining region of the connecting elements 46*c*. In this case, all cutting strand segments 10*c*, 48*c*, 52*c* have a respective cut-depth limiting element 20*c*. It is also conceivable, however, for only cutting strand segments 10*c*, 48*c*, 52*c* to have cut-depth limiting elements 20*c*, which are realized as cutting members or as driving members. Further combinations of an arrangement of cut-depth limiting elements 20*c* on the cutting strand segments 10*c*, 48*c*, 52*c* are likewise conceivable. In respect of further features of the cutting strand segments 10*c*, 48*c*, 52*c*, reference may be made to the description of FIGS. 1 to 3.

The invention claimed is:

1. A cutting strand segment for a cutting strand of a power-tool parting device, comprising:

a cutter carrier element that includes:

a cutting element disposed on the cutter carrier element;

a cut-depth limiting element disposed on the cutter carrier element and configured to limit a maximum depth of cut of the cutting element to a value that is less than 0.5 mm;

a connecting recess disposed on the cutter carrier element; and a connecting element integral with the cutter carrier element, the connecting element configured as a cylindrical stud fixedly extending from a coupling region of the cutter carrier element.

2. The cutting strand segment as claimed in claim 1, wherein the cut-depth limiting element is configured to limit a maximum depth of cut of the cutting element to a value that is less than 0.3 mm.

3. The cutting strand segment as claimed in claim 1, further comprising:

a transverse securing element disposed on the connecting element and configured to secure the cutter carrier element, when in a mounted state, against a transverse movement relative to a further cutting strand segment of the cutting strand.

4. The cutting strand segment as claimed in claim 3, wherein the transverse securing element has at least one securing region that is at least substantially parallel to a cutting plane of the cutting element.

5. The cutting strand segment as claimed in claim 1, the cutting strand segment having a maximum volume that is less than 20 $mm^3$.

6. The cutting strand segment as claimed in claim 1, wherein:

the connecting element defines a first central axis, the connecting recess defines a second central axis, a spacing of the cutting strand segment is defined as a linear distance between the first central axis and the second central axis, and the spacing is less than 4.0 mm.

7. The cutting strand segment as claimed in claim 6, wherein:

the cutting element defines a cutting plane, a width of the cutting strand segment is perpendicular to the cutting plane, and the width is less than 2.5 mm.

8. The cutting strand segment as claimed in claim 7, wherein a width of the cutting strand is less than or equal to the width of the cutting strand segment.

9. The cutting strand segment as claimed in claim 1, wherein:

the cylindrical stud defines a first diameter, the connecting recess defines a second diameter, and the first diameter is less than or equal to the second diameter.

10. The cutting strand segment as claimed in claim 1, further comprising:

a segment guide element disposed on the cutter carrier element and including a transverse extension, wherein the cylindrical stud defines a first longitudinal axis, wherein the transverse extension defines a second longitudinal axis that is parallel to the first longitudinal axis, wherein the cylindrical stud extends from the cutter carrier element in a first direction along the first longitudinal axis away from the cutter carrier element, wherein the transverse extension extends from the cutting carrier element in a second direction along the second longitudinal axis away from the cutting carrier element, and wherein the first direction is opposite the second direction.

11. A cutting strand for a power-tool parting device, comprising:

a first cutting strand segment that includes:

a first cutter carrier element having:

a first cutting element disposed on the first cutter carrier element;

a first cut-depth limiting element disposed on the first cutter carrier element and configured to limit a maximum depth of cut of the first cutting element to a value that is less than 0.5 mm;

a first connecting recess disposed on the first cutter carrier element; and a first connecting element integral with the first cutter carrier element, the first connecting element configured as a first cylindrical stud fixedly extending from a first coupling region of the first cutter carrier element; and a second cutting strand segment that includes:

a second cutter carrier element having:

a second cutting element disposed on the second cutter carrier element;

a second cut-depth limiting element disposed on the second cutter carrier element and configured to limit a maximum depth of cut of the second cutting element to a value that is less than 0.5 mm;

a second connecting recess disposed on the second cutter carrier element; and a second connecting element integral with the second cutter carrier element, the second connecting element configured as a second cylindrical stud fixedly extending from a second coupling region of the second cutter carrier element, wherein the first cylindrical stud is configured to be received by the second connecting recess to connect directly the first cutting strand segment to the second cutting strand segment.

12. The cutting strand as claimed in claim 11, wherein the first cutting strand segment and the second cutting strand segment are rotatably connected together, such that the second cutting strand element is rotatable about the first cylindrical stud.

13. The cutting strand as claimed in claim 11, wherein:

the first cutting strand segment further includes a transverse securing element disposed on the first connecting element and configured to secure the first cutter carrier element, when in a mounted state, against a transverse movement relative to the second cutter carrier element, and the transverse securing element is stamped onto the first connecting element to connect directly the first cutter carrier element to the second cutter carrier element.

14. A power tool system comprising:

a portable power tool; and a power-tool parting device supported by the portable power tool and having at least one cutting strand that includes:

a first cutting strand segment that has:

a first cutter carrier element with:

a first cutting element disposed on the first cutter carrier element;

a first cut-depth limiting element disposed on the first cutter carrier element and configured to limit a maximum depth of cut of the first cutting element to a value that is less than 0.5 mm; and a connecting recess disposed on the first cutter carrier element; and a second cutting strand segment that has:

a second cutter carrier element with:

a second cutting element disposed on the second cutter carrier element;

a second cut-depth limiting element disposed on the second cutter carrier element and configured to limit a maximum depth of cut of the second cutting element to a value that is less than 0.5 mm; and a connecting element integral with the second cutter carrier element, the connecting element configured as a cylindrical stud fixedly extending from a coupling region of the second cutter carrier element, wherein the cylindrical stud is configured to be received by the connecting recess to connect directly the first cutting strand segment to the second cutting strand segment.

15. The power tool system as claimed in claim 14, wherein:

the power-tool parting device further includes at least one guide unit; and the first cutting strand segment further includes at least one segment guide element disposed on the first cutter carrier element and configured to limit a movement of the first cutting strand segment away from the at least one guide unit along a direction that is at least substantially parallel to a cutting plane of the first cutting element.

16. The power tool system as claimed in claim 14, wherein the portable power tool includes a coupling device configured to couple the power-tool parting device to the portable power tool in at least one of a form-fitting and force fitting manner.

* * * * *